US009104223B2

(12) United States Patent
Zhong et al.

(10) Patent No.: US 9,104,223 B2
(45) Date of Patent: Aug. 11, 2015

(54) OUTPUT VOLTAGE VARIATION REDUCTION

(71) Applicant: Intel IP Corporation, Santa Clara, CA (US)

(72) Inventors: Kai Zhong, Gilbert, AZ (US); Chuanzhao Yu, Phoenix, AZ (US)

(73) Assignee: Intel IP Corporation, Santa Clara, CA (US)

( * ) Notice: Subject to any disclaimer, the term of this patent is extended or adjusted under 35 U.S.C. 154(b) by 114 days.

(21) Appl. No.: 13/894,275

(22) Filed: May 14, 2013

(65) Prior Publication Data

US 2014/0340067 A1 Nov. 20, 2014

(51) Int. Cl.

| | |
|---|---|
| ***G05F 1/575*** | (2006.01) |
| ***G05F 1/59*** | (2006.01) |
| ***G05F 1/46*** | (2006.01) |
| ***G05F 3/08*** | (2006.01) |

(52) U.S. Cl.

CPC *G05F 1/575* (2013.01); *G05F 1/59* (2013.01); *G05F 3/08* (2013.01); *G05F 1/462* (2013.01)

(58) Field of Classification Search

USPC ..... 323/265, 266, 271–285

See application file for complete search history.

(56) References Cited

U.S. PATENT DOCUMENTS

| | | | | |
|---|---|---|---|---|
| 5,506,496 | A | 4/1996 | Wrathall et al. | |
| 6,861,831 | B2 | 3/2005 | Ngiap Ho | |
| 7,554,309 | B2 * | 6/2009 | Carpenter et al. | 323/282 |
| 7,602,161 | B2 | 10/2009 | McLeod | |
| 7,714,553 | B2 * | 5/2010 | Lou | 323/276 |
| RE42,335 | E * | 5/2011 | Man et al. | 323/274 |
| 8,253,479 | B2 * | 8/2012 | Haddad et al. | 327/540 |
| 8,773,105 | B1 * | 7/2014 | Kang et al. | 323/315 |
| 2008/0204155 | A1 * | 8/2008 | Olmos et al. | 331/108 R |

* cited by examiner

*Primary Examiner* — Timothy J Dole
*Assistant Examiner* — Ishrat Jamali
(74) *Attorney, Agent, or Firm* — Baker Botts L.L.P.

(57) ABSTRACT

A method of reducing voltage variations in a power supply may include generating an intermediate voltage and setting a first-transistor gate voltage at a first-transistor gate of a first transistor of the power supply based on the intermediate voltage. The method may also include setting an output voltage at an output node of the power supply based on a second-transistor gate voltage at a second-transistor gate of a second transistor. Additionally, the method may include setting the second-transistor gate voltage based on the first-transistor gate voltage such that the output voltage is based on the intermediate voltage, a first-transistor threshold voltage of the first transistor, and a second-transistor threshold voltage of the second transistor and such that variations in the first-transistor threshold voltage and the second-transistor threshold voltage at least partially cancel each other out.

14 Claims, 6 Drawing Sheets

OUTPUT VOLTAGE VARIATION REDUCTION

FIELD

The embodiments discussed herein are related to reducing an output voltage variation of a power supply.

BACKGROUND

Electronic systems often include a power supply configured to supply a voltage to one or more components of the electronic systems. In some instances, the supply voltage of the power supply may vary, for example, due to process and/or temperature (PT) variations within the power supply. Some components that may receive the supply voltage may be susceptible to relatively small changes in the supply voltage, which may lead to reduced performance of the components. For example, a voltage-controlled oscillator (VCO) may output a signal having a specific frequency based on a tuning voltage that may be supplied by a power supply. Accordingly, the output signal frequency may vary based on variations in the supply voltage. In some instances, the VCO may be used with a phase-locked loop (PLL) and variations in the frequency of the output signal of the VCO may cause the PLL to unlock.

The subject matter claimed herein is not limited to embodiments that solve any disadvantages or that operate only in environments such as those described above. Rather, this background is only provided to illustrate one example technology area where some embodiments described herein may be practiced.

SUMMARY

According to an aspect of an embodiment, a method of reducing voltage variations in a power supply may include generating, by a voltage regulator, an intermediate voltage at an intermediate node of a power supply based on a reference voltage at a reference node of the power supply. The method may further include setting a first-transistor gate voltage at a first-transistor gate of a first transistor of the power supply based on the intermediate voltage. The method may also include setting an output voltage at an output node of the power supply based on a second-transistor gate voltage at a second-transistor gate of a second transistor. Additionally, the method may include setting the second-transistor gate voltage based on the first-transistor gate voltage such that the output voltage is based on the intermediate voltage, a first-transistor threshold voltage of the first transistor, and a second-transistor threshold voltage of the second transistor and such that variations in the first-transistor threshold voltage and the second-transistor threshold voltage at least partially cancel each other out.

The object and advantages of the embodiments will be realized and achieved at least by the elements, features, and combinations particularly pointed out in the claims.

It is to be understood that both the foregoing general description and the following detailed description are exemplary and explanatory and are not restrictive of the present disclosure, as claimed.

BRIEF DESCRIPTION OF THE DRAWINGS

Example embodiments will be described and explained with additional specificity and detail through the use of the accompanying drawings in which.

DESCRIPTION OF EMBODIMENTS

Figure 1:
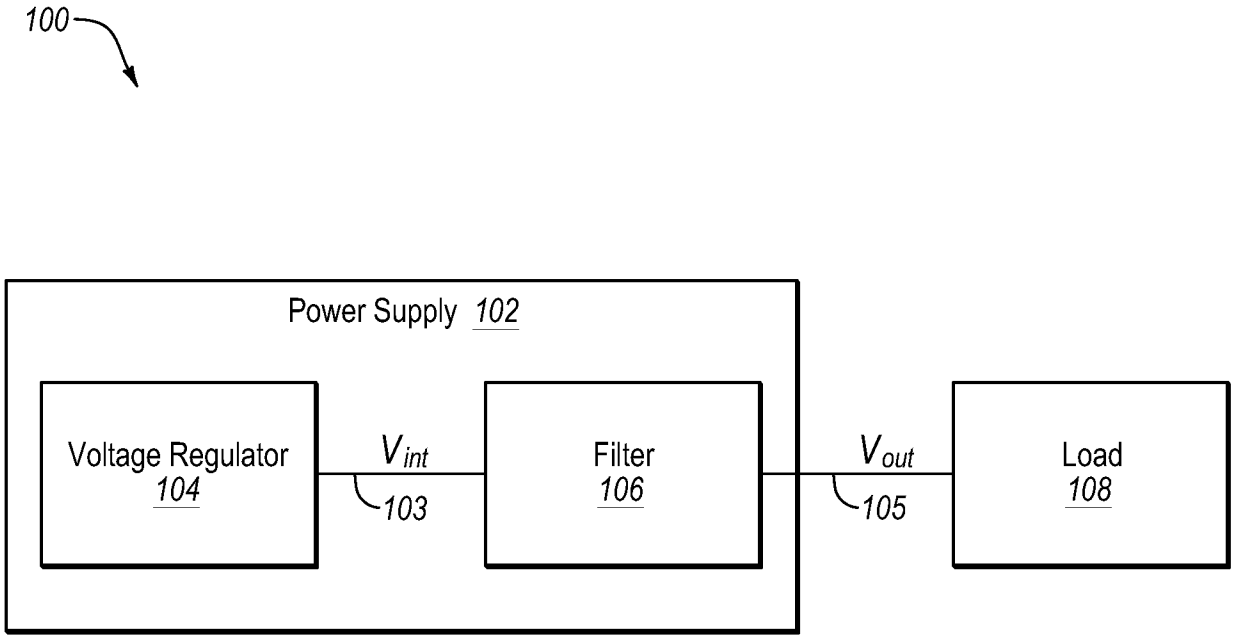
FIG. 1 illustrates an example system including a power supply configured to have an output voltage with reduced voltage variations.

According to some embodiments of the present disclosure, a power supply may be configured such that variations in its output voltage—which may be due to process and/or temperature (PT) variations within the power supply—may be reduced as compared to conventional power supplies. Accordingly, in some embodiments, the output voltage of the power supply of the present disclosure may be used as the supply voltage of components that may be susceptible to supply voltage variations such that performance of the components may be improved. For example, in some embodiments, the output voltage of the power supply may be used to supply a tuning voltage to a voltage-controlled oscillator (VCO) of a phase-locked loop (PLL) such that unlocking of the PLL due to variations in the frequency of the output signal of the VCO—which may be based on the tuning voltage supplied to the VCO—may be reduced.

As detailed below, in some embodiments, the power supply may include a reference node having a reference voltage, an intermediate node having an intermediate voltage and an output node having an output voltage. The power supply may include a voltage regulator configured to generate the intermediate voltage based on the reference voltage. The power supply may also include a first transistor and a second transistor each having a threshold voltage. The source of the first transistor (referred to hereinafter as the "first-transistor source") may be communicatively coupled to the intermediate node such that a gate voltage at the gate of the first transistor may be based on the intermediate voltage. The source of the second transistor (referred to hereinafter as the "second-transistor source") may be communicatively coupled to the output node such that the output voltage may be based on a gate voltage at the gate of the second transistor.

Additionally, the gate of the first transistor may be communicatively coupled to the gate of the second transistor such that the output voltage may be based on the intermediate voltage, and the threshold voltages of the first and second transistors. As explained in further detail below, the first transistor and the second transistor may be configured in the manner referred to above and such that the threshold voltage of the first transistor and the threshold voltage of the second transistor may at least partially cancel each other out. Additionally, as detailed below, the first transistor and the second transistor may be configured in the manner described above such that variations (e.g., PT-induced variations) in the threshold voltages of the first and second transistors may at least partially cancel each other out.

Therefore, the power supply of the present disclosure may be configured to reduce voltage variations of an output signal, which may improve the performance of components of which the power supply may supply a voltage. As mentioned above, in some embodiments, the power supply of the present disclosure may be implemented with respect to a VCO of a PLL to improve the performance of the PLL.

Embodiments of the present disclosure will be explained with reference to the accompanying drawings.

FIG. 1 illustrates an example system 100 including a power supply 102 configured to have an output voltage with a reduced voltage variation, arranged in accordance with at least one embodiment described herein. In some embodiments, the power supply 102 may include a voltage regulator 104 and a filter 106. The voltage regulator 104 may be any suitable system, apparatus, or device configured to output a voltage based on a reference voltage. For example, in some embodiments, the voltage regulator 104 may include a low-dropout voltage regulator (LDO). In the illustrated embodiment, the output of the voltage regulator 104 may be communicatively coupled to an intermediate node 103 of the power supply 102 such that the output voltage of the voltage regulator 104 may be used as an intermediate voltage ($V_{int}$) of the power supply 102. As explained in further detail below with respect to FIGS. 2 and 3, an output voltage ($V_{out}$) at an output node 105 of the power supply 102 may be based on the intermediate voltage $V_{int}$ at the intermediate node 103.

The power supply 102 may also include a filter 106 communicatively coupled to the intermediate node 103. The filter 106 may be any suitable system, apparatus, or device configured to filter out noise that may be associated with the intermediate voltage $V_{int}$ such that noise of the output voltage $V_{out}$ (which may be based on the intermediate voltage $V_{int}$) may be reduced or eliminated. For example, in some embodiments, the filter 106 may be a resistor-capacitor (RC) low-pass filter. Accordingly, the filter 106 may be configured to reduce variations in the output voltage $V_{out}$. Additionally, as described in detail below with respect to FIGS. 2 and 3, the power supply 102 may include other components configured such that variations (e.g., PT-induced variations) in the output voltage $V_{out}$ may be reduced or eliminated.

A load 108 may be communicatively coupled to the output node 105 of the power supply 102 such that the output voltage $V_{out}$ may act as the supply voltage of the load 108. The load 108 may include any suitable system, apparatus, or device for which the power supply 102 may provide power. For example, as mentioned above, in some embodiments, the load 108 may include a VCO of a PLL.

Figure 2:
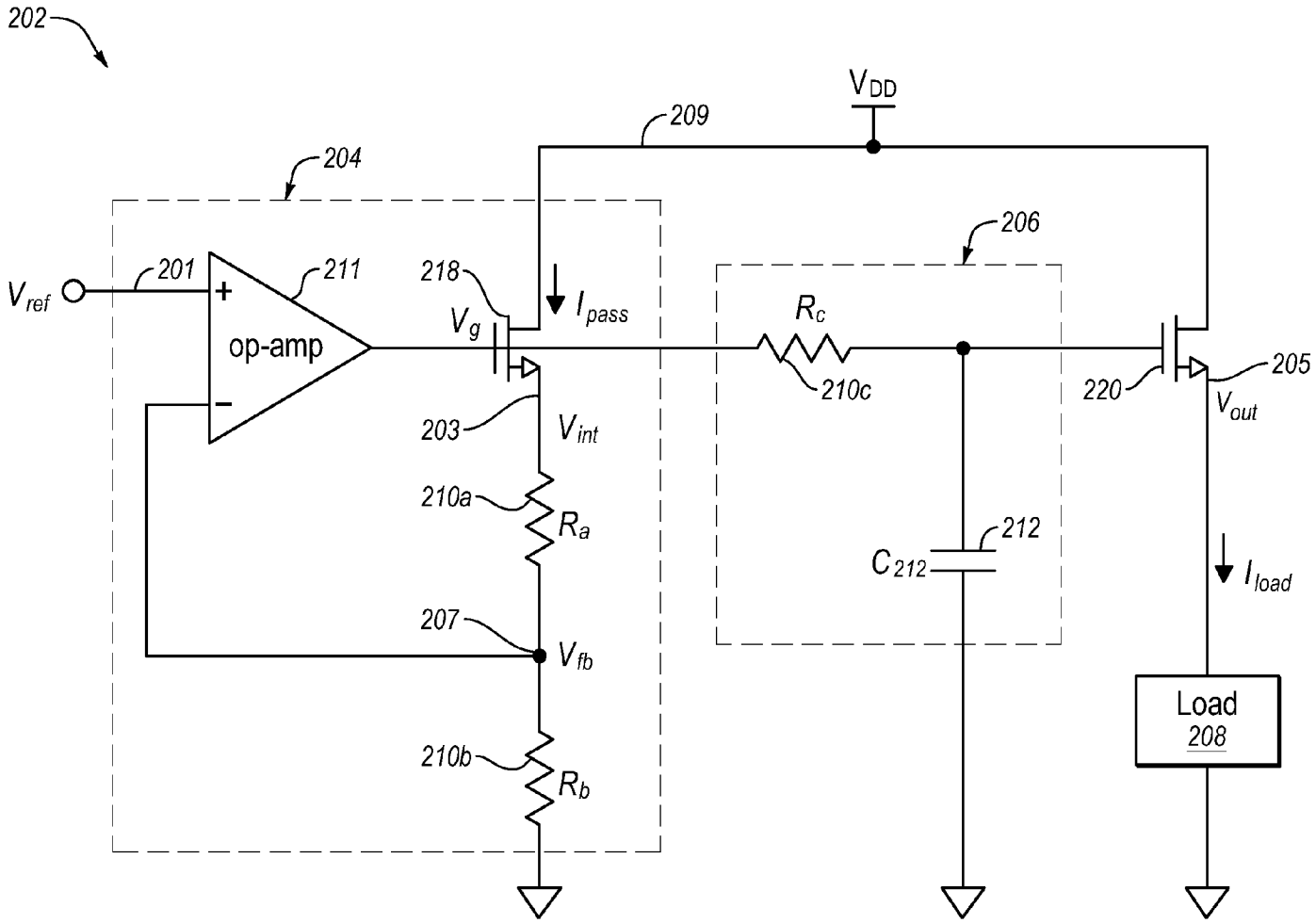
FIG. 2 illustrates an example embodiment of a power supply configured to have an output voltage with reduced voltage variations.

FIG. 2 illustrates an example embodiment of a power supply 202 configured to produce an output voltage with reduced voltage variations, arranged in accordance with at least one embodiment described herein. In some embodiments, the power supply 202 may be used as the power supply 102 of FIG. 1. As such, the power supply 202 may include a voltage regulator 204 that may be used as the voltage regulator 104 of FIG. 1 and the power supply 202 may also include a filter 206 that may be used as the filter 106 of FIG. 1.

In the illustrated embodiment, the voltage regulator 204 may be an LDO that may include a reference node 201 having a reference voltage ($V_{ref}$). The reference voltage $V_{ref}$ may be an input voltage used to establish an output voltage of the voltage regulator 204. In the illustrated embodiment, the output of the voltage regulator 204 may be communicatively coupled to an intermediate node 203 of the power supply 202. Accordingly, in the illustrated embodiment, an intermediate voltage $V_{int}$ of the power supply 202 at the intermediate node 203 may be substantially equal to the output voltage of the voltage regulator 204. Additionally, as detailed below, an output voltage $V_{out}$ at an output node 205 of the voltage supply 202 may be based on the intermediate voltage $V_{int}$. Therefore, due to the relationship between the reference voltage $V_{ref}$, the intermediate voltage $V_{int}$, and the output voltage $V_{out}$, the reference voltage $V_{ref}$ may be selected to provide the appropriate output voltage $V_{out}$ to drive one or more loads that may be communicatively coupled to the output node 205, such as a load 208.

In the illustrated embodiment, the voltage regulator 204 may include an operational amplifier (op-amp) 211 communicatively coupled to reference node 201 and configured to drive the intermediate voltage $V_{int}$ (and consequently drive the output voltage $V_{out}$) according to the reference voltage $V_{ref}$. In some embodiments, the non-inverting terminal of the op-amp 211 may be communicatively coupled to the reference node 201 such that the voltage received at the non-inverting terminal of the op-amp 211 may be approximately equal to the reference voltage $V_{ref}$. Additionally, the inverting terminal of the op-amp 211 may be communicatively coupled to a feedback node 207 of the voltage regulator 204 that may have a feedback voltage $V_{fb}$.

The voltage regulator 204 may also include a resistor 210*a* having a resistance $R_a$ and a resistor 210*b* having a resistance $R_b$. The resistors 210*a* and 210*b* may be communicatively coupled in series with each other and may each have an end communicatively coupled to the feedback node 207. The other end of the resistor 210*a* may be communicatively coupled to the intermediate node 203 and the other end of the resistor 210*b* may be communicatively coupled to ground. Accordingly, the resistors 210*a* and 210*b* may create a voltage divider between the intermediate node 203 and the feedback node 207. Additionally, due to the high resistance between the inverting and non-inverting terminals of the op-amp 211, the feedback voltage $V_{fb}$ may be approximately equal to the reference voltage $V_{ref}$. Therefore, due to the voltage divider created by the resistors 210*a* and 210*b* and the characteristics of the op-amp 211, the intermediate voltage $V_{int}$, the feedback voltage $V_{fb}$, and the reference voltage $V_{ref}$ may be approximately related to each other by the following expression:

$$V_{int} = V_{fb} * \left(1 + \frac{R_a}{R_b}\right) \approx V_{ref} * \left(1 + \frac{R_a}{R_b}\right)$$

Therefore, the values of $R_a$ and $R_b$ and $V_{ref}$ may be selected such that a desired value for $V_{int}$—of which $V_{out}$ may be based as detailed below—may be obtained.

Additionally, the intermediate node 203 may be communicatively coupled to a pass transistor 218. The pass transistor 218 may be any suitable transistor configured to supply current to the intermediate node 203. In some embodiments, the pass transistor 218 may be an npn metal-oxide-semiconductor field-effect transistor (MOSFET or NMOS transistor). The pass transistor 218 may include a drain, a source, and a gate. The drain of the pass transistor 218 may be communicatively coupled to a supply node 209 having a supply voltage ($V_{DD}$). The supply node 209 may provide the supply voltage $V_{DD}$ to the drain of the pass transistor 218 such that a pass current ($I_{pass}$) may flow through the pass transistor 218 into the intermediate node 203. Additionally, in the illustrated embodiment, the output of the op-amp 211 may provide a gate voltage ($V_g$) to the gate of the pass transistor 218 such that the current $I_{pass}$ may pass through the pass transistor 218.

The amount of current $I_{pass}$ that may pass through the pass transistor 218 from the drain to the source of the pass transistor 218 may be represented by the following expression:

$$I_{pass} = \frac{\mu C_{ox} W_{pass}}{2L_{pass}}(V_g - V_{int} - V_{TH,pass})^2$$

As mentioned above, in the above expression, "$I_{pass}$" may represent the current that may pass through the pass transistor 218, "$V_g$" may represent the gate voltage of the pass transistor 218, and "$V_{int}$" may represent the intermediate voltage at the intermediate node 203. Additionally, in the above expression, "μ" may indicate the mobility of electrons in the pass transistor 218, "$C_{ox}$" may indicate the oxide capacitance of the pass transistor 218, "$W_{pass}$" may indicate the channel width of the pass transistor 218, "$L_{pass}$" may indicate the channel length of the pass transistor 218, and "$V_{TH,pass}$" may represent the threshold voltage of the pass transistor 218.

Additionally, the output node 205 may be communicatively coupled to an output transistor 220. The output transistor 220 may be any suitable transistor configured to supply current to the output node 205. In some embodiments, the output transistor 220 may be an NMOS transistor. The output transistor 220 may include a drain, a source, and a gate. The drain of the output transistor 220 may be communicatively coupled to the supply node 209 such that the supply node 209 may provide the supply voltage $V_{DD}$ to the drain of the output transistor 220. Accordingly, the supply voltage $V_{DD}$ may allow for a load current ($I_{load}$) to flow through the output transistor 220 into the output node 205. The load current $I_{load}$ may be the current drawn by the load 208 that may be communicatively coupled to the output node 205.

Additionally, in the illustrated embodiment, the gate of the pass transistor 218 may be communicatively coupled to the gate of the output transistor 220 such that the output of the op-amp 211 may also provide the gate voltage $V_g$ to the gate of the output transistor 220 also. Accordingly, the op-amp 211 may also drive the output transistor 220 such that the current $I_{load}$ may pass through the output transistor 220.

The amount of current $I_{load}$ that may pass through the output transistor 220 from the drain to the source of the output transistor 220 may be represented by the following expression:

$$I_{load} = \frac{\mu C_{ox} W_{output}}{2L_{output}}(V_g - V_{out} - V_{TH,output})^2$$

As mentioned above, in the above expression, "$I_{load}$" may represent the current that may pass through the output transistor 220, "$V_g$" may represent the gate voltage of the output transistor 220 (which may be substantially the same as the gate voltage of the pass transistor 218), and "$V_{out}$" may represent the output voltage at the output node 205. Additionally, in the above expression, "μ" may indicate the mobility of electrons in the output transistor 220 (which may be the same as the mobility of electrons in the pass transistor 218), "$C_{ox}$" may indicate the oxide capacitance of the output transistor 220 (which may be the same as the oxide capacitance of the pass transistor 218), "$W_{output}$" may indicate the channel width of the output transistor 220, "$L_{output}$" may indicate the channel length of the output transistor 220, and "$V_{TH,output}$" may represent the threshold voltage of the output transistor 220 (which may be substantially the same as the threshold voltage $V_{TH,pass}$ of the pass transistor 218.

The pass transistor 218 and the output transistor 220 may be configured such that the output voltage $V_{out}$ may be based on the intermediate voltage $V_{int}$ (as mentioned above) and the threshold voltages $V_{TH,pass}$ and $V_{TH,output}$ of the pass transistor 218 and the output transistor 220, respectively. Additionally, the threshold voltages $V_{TH,pass}$ and $V_{TH,output}$ may vary according to PT variations. Accordingly, the pass transistor 218 and the output transistor 220 may also be configured such that variations in the threshold voltages $V_{TH,pass}$ and $V_{TH,output}$ of the pass transistor 218 and the output transistor 220, respectively, may at least partially cancel each other out.

For example, in some embodiments, the pass transistor 218 and the output transistor 220 may be configured such that the channel lengths $L_{pass}$ and $L_{output}$ may be approximately equal to each other (e.g., $L_{pass}$ $L_{output}$). Additionally, the pass transistor 218 and the output transistor 220 may be configured such that the ratio of the channel width $W_{pass}$ with respect to the channel width $W_{output}$ ($W_{pass}/W_{output}$) may be substantially equal to the ratio of the current $I_{pass}$ with respect to the current $I_{load}$ ($I_{load}/I_{load}$) (e.g., $W_{pass}/W_{output}=I_{pass}/I_{load}$). Therefore, the above-referenced expressions may be expressed as:

$$\frac{I_{pass}}{I_{load}} = \frac{\frac{\mu C_{ox} W_{pass}}{2L_{pass}}(V_g - V_{int} - V_{TH,pass})^2}{\frac{\mu C_{ox} W_{output}}{2L_{output}}(V_g - V_{out} - V_{TH,output})^2}$$

Based on $I_{pass}/I_{load}$ being approximately equal to $W_{pass}/W_{output}$, $L_{pass}$ being approximately equal to $L_{output}$, and the gate voltages of the pass transistor 218 and the output transistor 220 both being $V_g$, the above expression may be simplified and solved for $V_{out}$ to yield the following expression:

$$V_{out}=V_{int}+V_{TH,pass}-V_{TH,output}$$

Additionally, as mentioned above, the threshold voltages $V_{TH,pass}$ and $V_{TH,output}$ may be approximately equal to each other and variations (e.g., PT variations) in $V_{TH,pass}$ and $V_{TH,output}$ may also substantially track each other such that the above expression may be simplified to:

$$V_{out}=V_{int}$$

Therefore, in the illustrated embodiment, $V_{TH,pass}$ and $V_{TH,output}$ and their associated variations (e.g., PT variations) may substantially cancel each other out. Additionally, the output of the voltage regulator 204 may be substantially even with respect to PT variations such that $V_{int}$ may be substantially even with respect to PT variations. Accordingly, $V_{out}$ may be substantially even with respect to PT variations.

Additionally, as described above, $V_{int}$ may be based on the following expression:

$$V_{int} = V_{fb} * \left(1 + \frac{R_a}{R_b}\right) \approx V_{ref} * \left(1 + \frac{R_a}{R_b}\right)$$

Therefore, $V_{out}$ may be based on the following expression:

$$V_{out} = V_{int} = V_{fb} * \left(1 + \frac{R_a}{R_b}\right) \approx V_{ref} * \left(1 + \frac{R_a}{R_b}\right)$$

As such, $V_{ref}$, $R_a$, and $R_b$ may be selected such that $V_{out}$ may provide a desired amount of voltage to the load 208 that may be communicatively coupled to the output node 205.

In some embodiments, the power supply 202 may also include a filter 206 (e.g., an RC filter) that may include a resistor 210*c* having a resistance $R_c$ and a capacitor 212 having a capacitance $C_{212}$. The RC filter 206 may be communicatively coupled between the gates of the pass transistor 218 and the output transistor 220 and may be configured to filter out noise that may be associated with the intermediate voltage $V_{int}$ (e.g., noise produced by the voltage regulator 204) such that noise in the output voltage $V_{out}$ may be reduced or eliminated with respect to noise in the intermediate voltage $V_{int}$. Accordingly, the RC filter 206 may also be configured to reduce variations in the output voltage $V_{out}$ by reducing noise in the output voltage $V_{out}$. The resistance $R_c$ and the capacitance $C_{212}$ may be selected based on desired filtering characteristics of the RC filter 206 such as the time constant and frequencies to be filtered.

Accordingly, the power supply 202 may be configured to reduce voltage variations in the output voltage $V_{out}$ such that reduced performance of the load 208 due to variations in the output voltage $V_{out}$ may be reduced. Modifications, additions, or omissions may be made to the power supply 202 without departing from the scope of the present disclosure. For example, the power supply 202 may include other components not expressly depicted while still performing the functions described herein.

Figure 3:
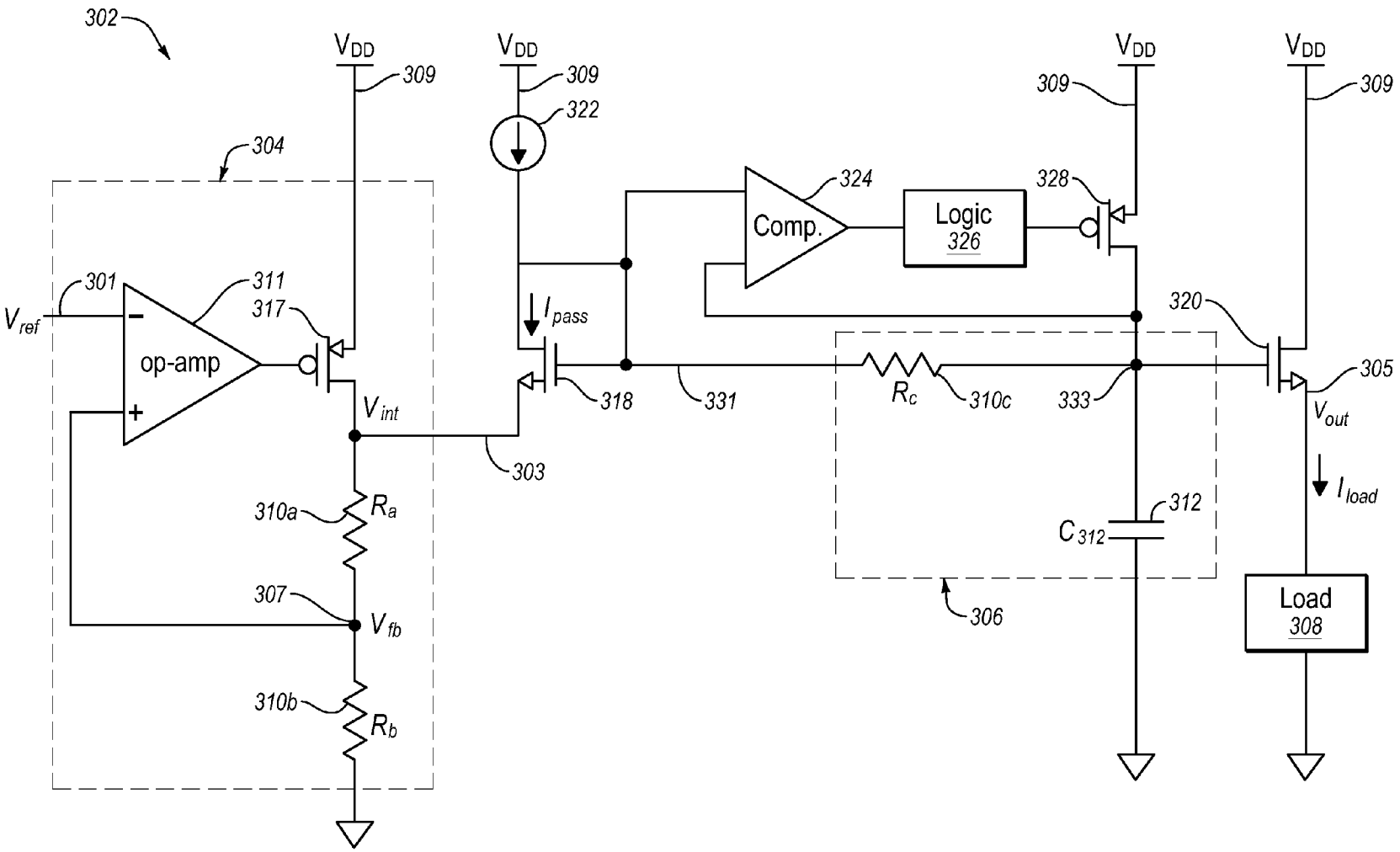
FIG. 3 illustrates an example embodiment of another power supply configured to have an output voltage with reduced voltage variations.

FIG. 3 illustrates an example embodiment of another power supply 302 configured to have an output voltage with reduced voltage variations, arranged in accordance with at least one embodiment described herein. In some embodiments, the power supply 302 may be used as the power supply 102 of FIG. 1. As such, the power supply 302 may include a voltage regulator 304 that may be used as the voltage regulator 104 of FIG. 1 and the power supply 302 may also include a filter 306 that may be used as the filter 106 of FIG. 1.

In the illustrated embodiment, the voltage regulator 304 may be an LDO that may include an op-amp 311, a resistor 310*a* having resistance $R_a$, a resistor 310*b* having resistance $R_b$, and a regulator transistor 317. The voltage regulator 304 may be communicatively coupled to a reference node 301 of the power supply 302 having reference voltage $V_{ref}$, an intermediate node 303 of the power supply 302 having intermediate voltage $V_{int}$, and a feedback node 307 of the power supply 302 having feedback voltage $V_{fb}$.

The op-amp 311, the resistor 310*a*, the resistor 310*b*, and the regulator transistor 317 may be configured such that the voltage regulator 304 may set the intermediate voltage $V_{int}$ in the power supply 302 based on the reference voltage, the resistance $R_a$, the resistance $R_b$, and the feedback voltage $V_{fb}$ in a manner similar to that described above with respect to the op-amp 211, the resistor 210*a*, the resistor 210*b*, and the pass transistor 218, respectively, setting the intermediate voltage $V_{int}$ in the power supply 202 of FIG. 2. Therefore, the intermediate voltage $V_{int}$ in the power supply 302 may also be determined by the following expression:

$$V_{int} = V_{fb} * \left(1 + \frac{R_a}{R_b}\right) \approx V_{ref} * \left(1 + \frac{R_a}{R_b}\right)$$

The regulator transistor 317 in the illustrated embodiment may be a pnp MOSFET (PMOS transistor) such that the inverting and non-inverting terminal configuration of the op-amp 311 may be opposite that of the inverting and non-inverting terminal configuration of the op-amp 211 of FIG. 2. However, the voltage regulator 304 may set the intermediate voltage $V_{int}$ in substantially the same manner as described above with respect to the voltage regulator 204 of FIG. 2.

Additionally, as described in further detail below, unlike the gate of the pass transistor 218—which may be configured with respect to the voltage regulator 204 in a manner similar to the configuration of the regulator transistor 317 with respect to the voltage regulator 304—being communicatively coupled to the gate of the output transistor 220 of FIG. 2, the gate of the regulator transistor 317 may not be communicatively coupled to the gate of an output transistor 320 communicatively coupled to an output node 305 of the power supply 302. Instead, the power supply 302 may include another transistor, a pass transistor 318, that may be configured with respect the output transistor 320 in a similar manner that the pass transistor 218 may be configured with respect to the output transistor 220 of FIG. 2.

For example, the pass transistor 318 may include a drain, a source, and a gate. The source of the pass transistor 318 may be communicatively coupled to the intermediate node 303. Further, the drain of the pass transistor 318 may be communicatively coupled to a current source 322 configured to supply a reference current to the drain of the pass transistor 318 such that the reference current may be used as the pass current $I_{pass}$ that may flow through the pass transistor 318 into the intermediate node 303. Additionally, in the illustrated embodiment, the drain of the pass transistor 318 may be communicatively coupled to the gate of the pass transistor 318 such that the pass transistor 318 may be configured as a diode, which may allow the current $I_{pass}$ to pass through the pass transistor 318.

Similar to the amount of current that may pass through the pass transistor 218 of FIG. 2, the amount of current $I_{pass}$ (which in the illustrated embodiment may be set by the reference current of the current source 322) that may pass through the pass transistor 318 of FIG. 3 may be represented by the following expression (which may be the same expression that may be used to represent the amount of current $I_{pass}$ that may pass through the pass transistor 218 of FIG. 2):

$$I_{pass} = \frac{\mu C_{ox} W_{pass}}{2L_{pass}}(V_g - V_{int} - V_{TH,pass})^2$$

As mentioned above, in the above expression, "$I_{pass}$" may represent the current that may pass through the pass transistor 318, "$V_g$" may represent the gate voltage of the pass transistor 318, and "$V_{int}$" may represent the intermediate voltage at the intermediate node 303. Additionally, in the above expression, "μ" may indicate the mobility of electrons in the pass transistor 318, "$C_{ox}$" may indicate the oxide capacitance of the pass transistor 318, "$W_{pass}$" may indicate the channel width of the pass transistor 318, "$L_{pass}$" may indicate the channel length of the pass transistor 318, and "$V_{TH,pass}$" may represent the threshold voltage of the pass transistor 318.

The gate of the pass transistor 318 may be communicatively coupled to the gate of the output transistor 320, similar to the gate of the pass transistor 218 being communicatively coupled to the gate of the output transistor 220 in FIG. 2. Additionally, the output transistor 320 may be communicatively coupled to a supply node 309 of the power supply 302 and the output node 305 in a manner substantially similar to the configuration of the output transistor 220 with respect to the supply node 209 and the output node 205 of FIG. 2. Accordingly, a load current $I_{load}$ that may be drawn by a load 308 communicatively coupled to the output node 305 may pass through the output transistor 320. The amount of load current $I_{load}$ that may pass through the output transistor 320 of FIG. 3 may be represented by the following expression (which may be the same expression that may be used to represent the amount of load current $I_{load}$ that may pass through the output transistor 220 of FIG. 2):

$$I_{load} = \frac{\mu C_{ox} W_{output}}{2L_{output}}(V_g - V_{out} - V_{TH,output})^2$$

As mentioned above, in the above expression, "$I_{load}$" may represent the current that may pass through the output transistor 320, "$V_g$" may represent the gate voltage of the output transistor 320 (which may be substantially the same as the gate voltage of the pass transistor 318), and "$V_{out}$" may represent the output voltage at the output node 305. Additionally, in the above expression, "μ" may indicate the mobility of electrons in the output transistor 320 (which may be the same as the mobility of electrons in the pass transistor 318), "$C_{ox}$" may indicate the oxide capacitance of the output transistor 320 (which may be the same as the oxide capacitance of the pass transistor 318), "$W_{output}$" may indicate the channel width of the output transistor 320, "$L_{output}$" may indicate the channel length of the output transistor 320, and "$V_{TH,output}$" may represent the threshold voltage of the output transistor 320 and may be substantially equal to the threshold voltage $V_{TH,pass}$ of the pass transistor 318.

Similar to the pass transistor 218 and the output transistor 220 of FIG. 2, the pass transistor 318 and the output transistor 320 may be configured such that the output voltage $V_{out}$ may be based on the intermediate voltage $V_{int}$ (as mentioned above) and the threshold voltages $V_{TH,pass}$ and $V_{TH,output}$ of the pass transistor 318 and the output transistor 320, respectively. Additionally, the pass transistor 318 and the output transistor 320 may be configured such that the threshold voltages $V_{TH,pass}$ and $V_{TH,output}$ of the pass transistor 318 and the output transistor 320 may substantially cancel each other out and such that variations (e.g., PT variations) in the threshold voltages $V_{TH,pass}$ and $V_{TH,output}$ of the pass transistor 318 and the output transistor 320, respectively, may track each other such that the variations at least partially cancel each other out.

For example, in some embodiments, the pass transistor 318 and the output transistor 320 may be configured such that the channel lengths $L_{pass}$ and $L_{output}$ may be approximately equal to each other (e.g., $L_{pass}=L_{output}$). Additionally, the current source 322, the pass transistor 318, and the output transistor 320 may be configured such that the ratio of the channel width $W_{pass}$ of the pass transistor 318 with respect to the channel width $W_{output}$ of the output transistor 320 ($W_{pass}/W_{output}$) may be substantially equal to the ratio of the current $I_{pass}$ of the pass transistor 318 (which may be set by the reference current of the current source 322) with respect to the current $I_{load}$ of the output transistor 320 ($I_{pass}/I_{load}$) (e.g., $W_{pass}/W_{output}=I_{pass}/I_{load}$). Accordingly, based on this configuration, the output voltage $V_{out}$ of the output node 305 may be indicated by the following expression:

$$V_{out}=V_{int}+V_{TH,pass}-V_{TH,output}$$

Additionally, as mentioned above, the threshold voltages $V_{TH,pass}$ and $V_{TH,output}$ of the pass transistor 318 and the output transistor 320, respectively, may be approximately equal to each other and variations (e.g., PT variations) in $V_{TH,pass}$ and $V_{TH,output}$ may also substantially track each other such that the above expression may be simplified to:

$$V_{out}=V_{int}$$

Therefore, similar to the embodiment of FIG. 2, in the illustrated embodiment of FIG. 3, PT variations in the threshold voltages $V_{TH,pass}$ and $V_{TH,output}$ of the pass transistor 318 and the output transistor 320, respectively, may substantially cancel each other out. Additionally, the output of the voltage regulator 304 may be substantially even with respect to PT variations such that $V_{int}$ of the power supply 302 may be substantially even with respect to PT variations. Accordingly, $V_{out}$ of the power supply 302 may be substantially even with respect to PT variations.

Additionally, as described above, $V_{int}$ of the power supply 302 may be based on the following expression:

$$V_{int} = V_{fb} * \left(1 + \frac{R_a}{R_b}\right) \approx V_{ref} * \left(1 + \frac{R_a}{R_b}\right)$$

Therefore, $V_{out}$ of the power supply 302 may be based on the following expression:

$$V_{out} = V_{int} = V_{fb} * \left(1 + \frac{R_a}{R_b}\right) \approx V_{ref} * \left(1 + \frac{R_a}{R_b}\right)$$

As such, $V_{ref}$, $R_a$, and $R_b$ of the power supply 302 may be selected such that $V_{out}$ may provide a desired amount of voltage to the load 308 that may be communicatively coupled to the output node 305.

In some embodiments, the power supply 302 may also include a filter 306 (e.g., an RC filter) that may include a resistor 310*c* having a resistance R, and a capacitor 312 having a capacitance $C_{312}$. The RC filter 306 may be configured similar to the RC filter 206 such that the RC filter 306 may be configured to filter out noise that may be associated with the intermediate voltage $V_{int}$ (e.g., noise produced by the voltage regulator 304) such that noise of the output voltage $V_{out}$ may be reduced or eliminated with respect to the noise of the intermediate voltage $V_{int}$.

In some embodiments, the power supply 302 may include a charge device 328 configured to decrease a settling time of the RC filter 306. The charge device 328 may include any suitable system, apparatus, or device configured to supply a current to the capacitor 312 upon initialization of the power supply 302 such that the capacitor 312 may charge more quickly than if the charge device 328 were not present. Accordingly, the charge device 328 may reduce the settling time of the RC filter 306.

In the illustrated embodiment, the charge device 328 may include a PMOS transistor that may include a source communicatively coupled to the supply node 309 and a drain communicatively coupled to the capacitor 312 such that when the PMOS transistor is turned on, the supply node 309 may supply a current to the capacitor 312 to charge the capacitor 312. The PMOS transistor may also include a gate communicatively coupled to a logic circuit 326, which may be communicatively coupled to a comparator 324. The logic circuit 326 and the comparator 324 may be configured to turn on the PMOS transistor to charge the capacitor 312 and may be configured to turn off the PMOS transistor when the capacitor is substantially charged.

For example, the comparator 324 may be configured to compare a voltage at a pass-transistor gate node 331 with a voltage at an output-transistor gate node 333 to determine whether the voltages at the pass-transistor gate node 331 and the output-transistor gate node 333 are substantially equal to each other. In some instances, for example at initiation of the power supply 302, when the voltage at the pass-transistor gate node 331 is not substantially equal to the voltage at the output-transistor gate node 333, the capacitor 312 may not be substantially charged and when the voltage at the pass-transistor gate node 331 is substantially equal to the voltage at the output-transistor gate node 333, the capacitor 312 may be substantially charged.

Accordingly, when the voltage at the pass-transistor gate node 331 is not substantially equal to the voltage at the output-transistor gate node 333, the comparator 324 may output a comparison signal indicating such to the logic circuit 326, which may consequently output a control signal that may turn the charge device 328 (e.g., the PMOS transistor) on. Conversely, when the voltage at the pass-transistor gate node 331 is substantially equal to the voltage at the output-transistor gate node 333, the comparator 324 may output a comparison signal indicating such to the logic circuit 326, which may consequently output a control signal that may turn the charge device 328 (e.g., PMOS transistor) off.

In some instances, after the capacitor 312 has been substantially charged such that the charge device 328 may be turned off, the voltages at the pass-transistor gate node 331 and/or the output-transistor gate node 333 may vary based on noise that may occur within the power supply 302 such that they may not be substantially equal to each other. However, turning on the charge device 328 every time the comparator 324 detects a voltage difference between the pass-transistor gate node 331 and the output-transistor gate node 333 may reduce performance of the power supply 302 and/or the load 308. Accordingly, in some embodiments, the logic circuit 326 may be configured to turn on the charge device 328 at initialization of the power supply 302, but not again after the charge device 328 has been turned off until another initialization of the power supply 302.

Figure 4A:
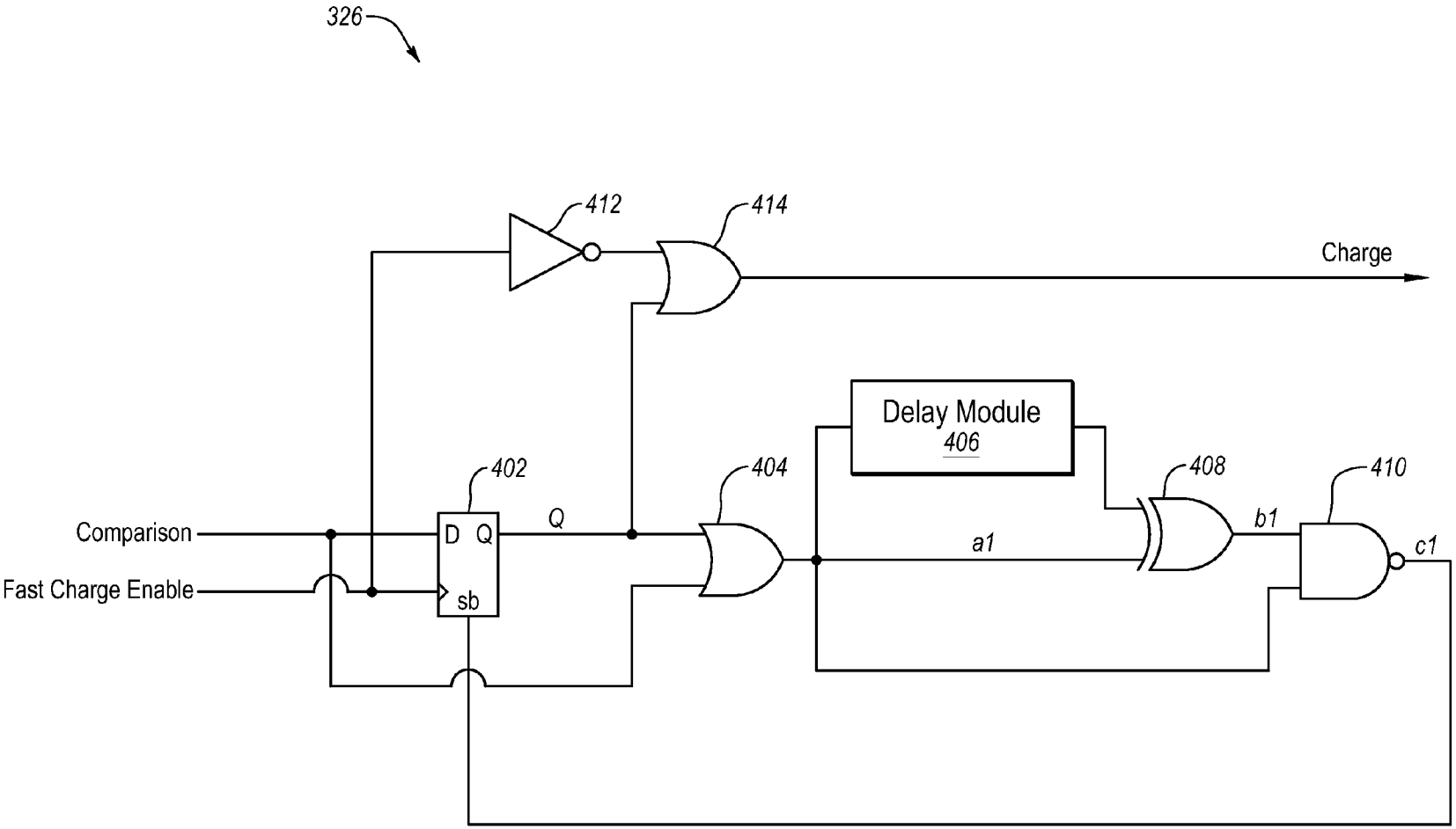
FIG. 4A illustrates an example embodiment of a logic circuit of FIG. 3.

FIG. 4A illustrates an example embodiment of the logic circuit 326 of FIG. 3 configured in the manner as described above, arranged in accordance with at least one embodiment described herein. In some embodiments, the logic circuit 326 may include a D flip-flop 402, an OR gate 404, a delay module 406, an exclusive OR (XOR) gate 408, a negating AND (NAND) gate 410, an inverter 412, and an OR gate 414. The logic circuit 326 may be configured to receive the comparison signal (illustrated as "Comparison" in FIG. 4A) from the comparator 324 of FIG. 3 (not expressly depicted in FIG. 4A). The logic circuit 326 may also be configured to receive a "Fast Charge Enable" signal from a control unit (not expressly depicted in FIG. 4A) communicatively coupled to the logic circuit 326 and configured to control the logic circuit 326 and/or the power supply 302. The logic circuit 326 may be configured to produce a "Charge" signal as an output signal, which may be used to turn the charge device 328 of FIG. 3 (not expressly depicted in FIG. 4A) on and off. The logic circuit 326 may also produce internal signals "Q," "a1," "b1," and "c1" to produce the "Charge" signal. The operation of the logic circuit 326 of FIG. 4A may be understood with respect to a timing diagram of the logic circuit 326 of FIG. 4A.

Figure 4B:
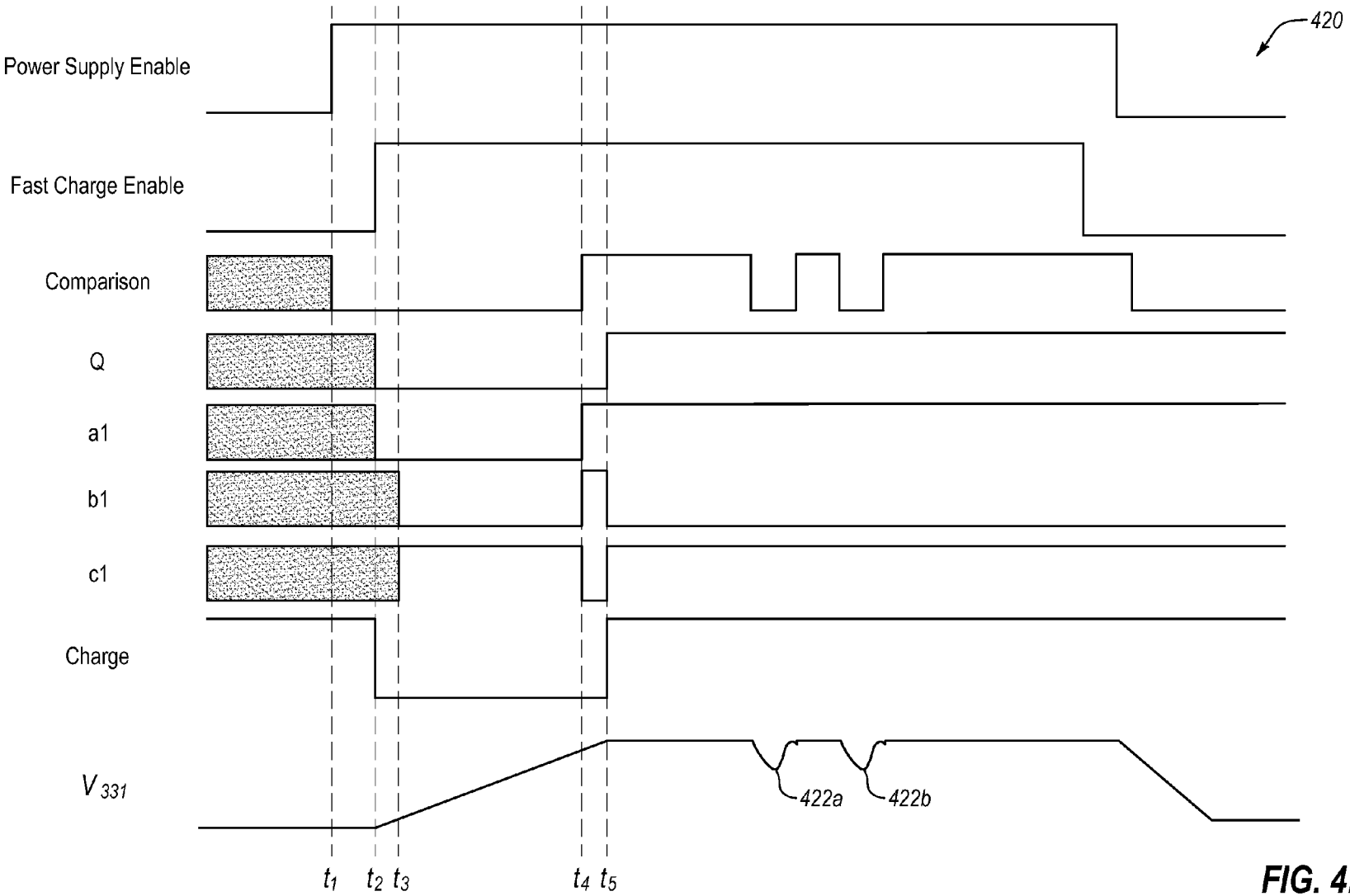
FIG. 4B illustrates a timing diagram of the operation of the logic circuit of FIG. 4A.

FIG. 4B illustrates a timing diagram 420 of the operation of the logic circuit 326 of FIG. 4A, in accordance with at least one embodiment described herein. The timing diagram 420 illustrates example waveforms of signals that may be affected by the operation of the logic circuit 326. At a time $t_1$ of the timing diagram 420 a "Power Supply Enable" signal may be asserted "HIGH" (i.e., set as a logic "1") to initialize the power supply 302, of which the logic circuit 326 may be included. In some embodiments, the "Power Supply Enable" signal may be asserted "HIGH" by the control unit configured to control the power supply 302.

In some embodiments, the control unit may include one or more microprocessors, microcontrollers, digital signal processors (DSP), application-specific integrated circuits (ASIC), a Field-Programmable Gate Array (FPGA), or any other digital or analog circuitry configured to interpret and/or to execute program instructions and/or to process data. In some embodiments, the program instructions and/or process data may be stored in memory.

The memory may include any suitable computer-readable media configured to retain program instructions and/or data for a period of time. By way of example, and not limitation, such computer-readable media may include tangible, non-transitory computer-readable storage media including Random Access Memory (RAM), Read-Only Memory (ROM), Electrically Erasable Programmable Read-Only Memory (EEPROM), Compact Disc Read-Only Memory (CD-ROM) or other optical disk storage, magnetic disk storage or other magnetic storage devices, flash memory devices (e.g., solid state memory devices), or any other storage medium which may be used to carry or store desired program code in the form of computer-executable instructions or data structures and which may be accessed by the processor. Combinations of the above may also be included within the scope of computer-readable media. Computer-executable instructions may include, for example, instructions and data that cause a general purpose computer, special purpose computer, or special purpose processing device (e.g., a processor) to perform a certain function or group of functions.

With the power supply 302 enabled at the time $t_1$, the comparator 324 of FIG. 3 may determine a difference between the voltages at the pass-transistor gate node 331 and the output-transistor gate node 333 of FIG. 3 such that the comparator 324 may assert the "Comparison" signal from an unknown value to "LOW" (i.e., a logic "0"). At a time $t_2$, the "Comparison" signal may still be asserted "LOW" and the control unit may assert the "Fast Charge Enable" signal "HIGH" to begin operation of the charge device 328 of FIG. 3.

In the illustrated embodiment of FIG. 4A, a "D" input of the D flip-flop may be configured to receive the "Comparison" signal and a clock input of the D flip-flop 402 may be configured to receive the "Fast Charge Enable" signal. The D flip-flop may be configured to output the "Comparison" signal received at the "D" input as the "Q" signal on a rising edge of the "Fast Charge Enable" signal, which may occur when the "Fast Charge Enable" signal is asserted "HIGH" at the time $t_2$. Therefore, the "Q" signal may be asserted from an unknown value to "LOW" (like the "Comparison" signal) at approximately the time $t_2$.

The inverter 412 may be configured to receive the "Fast Charge Enable" signal and the OR gate 414 may be configured to receive the output of the inverter 412 as an input. Additionally, the OR gate 414 may be configured to receive the "Q" signal as an input and the output of the OR gate 414 may be configured to output the "Charge" signal. Therefore, at approximately time $t_2$, the OR gate 414 may assert the "Charge" signal "LOW," which, in the illustrated embodiment of FIG. 3, may turn the PMOS transistor of the charge device 328 on such that the charge device 328 may begin charging the capacitor 312 of FIG. 3.

Additionally, the OR gate 404 may be configured to receive the "Comparison" and "Q" signals such that the output of the OR gate 404—the "a1" signal—may also be asserted from an unknown value to "LOW" at approximately the time $t_2$. The "a1" signal may be configured to be received by the delay module 406 and the XOR gate 408. Additionally, an output of the delay module 406 may be received by the XOR gate 408. Accordingly, at a time $t_3$, after a delay associated with the delay module 406 has passed from the time $t_2$, the output of the XOR gate 408—the "b1" signal—may be asserted from an unknown value to "LOW." The NAND gate 410 may be configured to receive the "a1" and "b1" signals as inputs such that the output of the NAND gate 410—the "c1"—signal may be asserted "HIGH" at time $t_3$.

At a time $t_4$, the voltage at the pass-transistor gate node 331 (as represented by the signal "$V_{331}$" of the timing diagram 420) may be approximately equal to the voltage at the output-transistor gate node 333 such that the comparator 324 may assert the "Comparison" signal from "LOW" to "HIGH." The change in the "Comparison" signal may change the "a1" signal from "LOW" to "HIGH," which may assert the "b1" signal "HIGH" and may assert the "c1" signal "LOW" at approximately the time $t_4$.

At a time $t_5$, after the delay module 406 has delayed the change in the "a1" signal, the "b1" signal may be asserted back to "LOW" and the "c1" signal may be asserted back to "HIGH." A reset terminal of the D flip-flop 402 may be configured to receive the "c1" signal and may be configured to reset and assert the "Q" signal of the D flip-flop 402 "HIGH" on a rising edge of the "c1" signal. Therefore, at the time $t_5$, the "Q" signal may be asserted "HIGH" because the "c1" signal may be asserted from "LOW" to "HIGH," which may assert the "Charge" signal "HIGH," which, in the illustrated embodiment of FIGS. 3 and 4A, may turn off the charge device 328.

Now that the signal "Q" is asserted "HIGH" and because the "Fast Charge Enable" signal may be maintained "HIGH" by the control unit during operation of the power supply 302 such that the "Fast Charge Enable" signal may not have any rising or falling edges during operation of the power supply 302, the signal "Q" may not change from "HIGH" to "LOW" again until the power supply 302 is deactivated and re-initialized (e.g., turned off and then on again). Accordingly, fluctuations in the pass-transistor gate node 331, such as fluctuations 422*a* and 422*b* illustrated in the timing diagram 420, that may cause changes in the "Comparison" signal may not cause the "Charge" signal to be asserted "LOW" and turn on the charge device 328 of FIG. 3 again.

Therefore, the logic circuit 326 configured in a manner such as that described with respect to FIGS. 4A and 4B may be configured to activate the charge device 328 upon initialization of the power supply 302, but not during operation of the power supply 302 after the capacitor 312 has been initially charged. Additionally, the power supply 302 configured in a manner such as described above with respect to FIG. 3 may be configured to reduce fluctuations in the output voltage $V_{out}$ which may improve the performance of the power supply 302.

Modifications, additions, or omissions may be made to the power supply 302 without departing from the scope of the present disclosure. For example, in some embodiments, the logic circuit 326 may be configured in a different manner than that described with respect to FIGS. 4A and 4B. Additionally, in some embodiments, the power supply 302 may not include the comparator 324, the logic circuit 326, and/or the charge device 328. Also, in some embodiments, the comparator 324, the logic circuit 326, and/or the charge device 328 may be included in the power supply 202 of FIG. 2. Further, the power supply 302 may include other components not expressly depicted while still performing the functions described herein.

Figure 5:
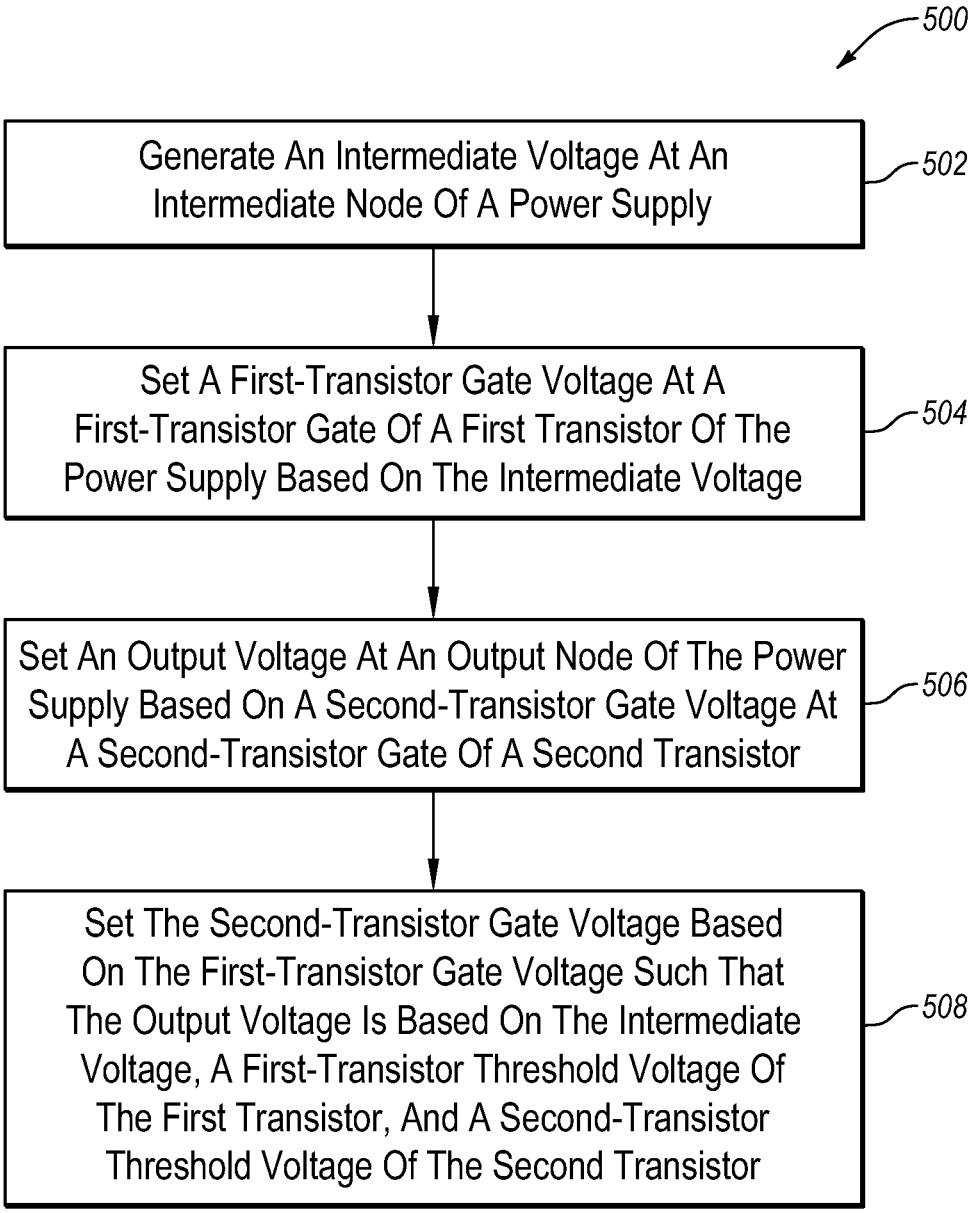
FIG. 5 is a flowchart of an example method of reducing voltage variations in a power supply.

FIG. 5 is a flowchart of an example method 500 of reducing voltage variations in a power supply, arranged in accordance with at least one embodiment described herein. The method 500 may be implemented, in some embodiments, by one or more components of a power supply, such as the power supplies 202 and 302 and their associated components described with respect to FIGS. 2 and 3-4B, respectively. Although illustrated as discrete blocks, various blocks may be divided into additional blocks, combined into fewer blocks, or eliminated, depending on the desired implementation.

The method 500 may begin, and at block 502 an intermediate voltage may be generated at an intermediate node of a power supply based on a reference voltage at a reference node of the power supply. In some embodiments, the intermediate voltage may be generated by a voltage regulator such as an LDO.

At block 504, a first-transistor gate voltage may be set at a first-transistor gate of a first transistor of the power supply based on the intermediate voltage. At block 506, an output voltage at an output node of the power supply may be set based on a second-transistor gate voltage at a second-transistor gate of a second transistor.

At block 508 the second-transistor gate voltage may be set based on the first-transistor gate voltage such that the output voltage may be based on the intermediate voltage, a first-transistor threshold voltage of the first transistor, and a second-transistor threshold voltage of the second transistor. Additionally, the second-transistor gate voltage may be set based on the first-transistor gate voltage such that variations (e.g., PT variations) in the first-transistor threshold voltage and the second-transistor threshold voltage at least partially cancel each other out, which may reduce variations in the output voltage.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

For example, in some embodiments, the method 500 may include additional steps associated with filtering out noise between the first-transistor gate and the second-transistor gate. In these and other embodiments, the method 500 may include steps associated with supplying a charge voltage to the second-transistor gate to reduce a settling time of a filter configured to perform the filtering. Additionally, the method 500 may include steps associated with comparing voltages at the first-transistor gate and the second-transistor gate and turning a charge device that may be supplying the charge voltage to the second-transistor gate off when the voltages at the first-transistor gate and the second-transistor gate are approximately equal. In these and other embodiments, the method 500 may include maintaining the charge device in an off state when the comparison indicates that the first gate voltage and the second gate voltage are no longer substantially equal to each other. Further, in some embodiments, the first and second transistors may be configured such that the first-transistor threshold voltage and the second-transistor threshold voltage substantially cancel each other out.

The embodiments described herein may include the use of a special purpose or general purpose computer including various computer hardware or software modules, as discussed in greater detail below.

Embodiments described herein may include computer-readable media for carrying or having computer-executable instructions or data structures stored thereon. As mentioned above with respect to the control unit, such computer-readable media may be any available media that may be accessed by a general purpose or special purpose computer. Additionally, computer-executable instructions may include, for example, instructions and data which cause a general purpose computer, special purpose computer, or special purpose processing device to perform a certain function or group of functions. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

As used herein, the terms "module" or "component" may refer to specific hardware implementations configured to perform the operations of the module or component and/or software objects or software routines that may be stored on and/or executed by general purpose hardware (e.g., computer-readable media, processing devices, etc.) of the computing system. In some embodiments, the different components, modules, engines, and services described herein may be implemented as objects or processes that execute on the computing system (e.g., as separate threads). While some of the system and methods described herein are generally described as being implemented in software (stored on and/or executed by general purpose hardware), specific hardware implementations or a combination of software and specific hardware implementations are also possible and contemplated. In this description, a "computing entity" may be any computing system as previously defined herein, or any module or combination of modules running on a computing system.

All examples and conditional language recited herein are intended for pedagogical objects to aid the reader in understanding the present disclosure and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

What is claimed is:

1. A power supply comprising:

a reference node having a reference voltage;

an intermediate node having an intermediate voltage;

an output node having an output voltage;

a voltage regulator configured to generate the intermediate voltage based on the reference voltage;

a first transistor having a first-transistor threshold voltage and including a first-transistor source and a first-transistor gate, the first-transistor source communicatively coupled to the intermediate node such that a first-transistor gate voltage at the first-transistor gate is based on the intermediate voltage; and a second transistor having a second-transistor threshold voltage and including a second-transistor source and a second-transistor gate, the second-transistor source communicatively coupled to the output node such that the output voltage is based on a second-transistor gate voltage at the second-transistor gate, the second-transistor gate being communicatively coupled to the first-transistor gate such that the output voltage is based on the intermediate voltage, the first-transistor threshold voltage, and the second-transistor threshold voltage and such that variations in the first-transistor threshold voltage and the second-transistor threshold voltage at least partially cancel each other out; and a filter communicatively coupled between the first-transistor gate and the second transistor gate and configured to filter out noise associated with the intermediate voltage such that noise of the output voltage may be reduced with respect to the intermediate voltage; and a charge device configured to supply a charge voltage to the second-transistor gate to reduce a settling time of the filter;

a comparator configured to compare a first-gate voltage of the first-transistor gate with a second-gate voltage of the second-transistor gate; and a logic module communicatively coupled to the comparator and the charge device and configured to turn off the charge device when the comparator indicates that the second-gate voltage is substantially equal to the first-gate voltage.

2. The power supply of claim 1, wherein the voltage regulator includes the first transistor.

3. The power supply of claim 1, wherein the logic module is configured to maintain the charge device in an off state when the comparator indicates that the first gate voltage and the second gate voltage are no longer substantially equal to each other.

4. The power supply of claim 1, wherein the first transistor and the second transistor are configured such that the output voltage is substantially equal to the intermediate voltage.

5. The power supply of claim 1, wherein the first-transistor includes a first-transistor drain communicatively coupled to the first-transistor gate such that the first transistor acts as a diode.

6. The power supply of claim 1, further comprising:

a load communicatively coupled to the output node and drawing a load current through the second transistor and the output node; and a current source configured to supply a reference current through the first transistor, wherein the current source, the first transistor, and the second transistor are configured such that a current ratio of the reference current with respect to the load current is substantially equal to a width ratio of a first-transistor width of the first transistor with respect to a second-transistor width of the second transistor.

7. The power supply of claim 1, wherein the first transistor and the second transistor are configured such that the first-transistor threshold voltage and the second-transistor threshold voltage substantially cancel each other out.

8. The power supply of claim 1, wherein the first transistor and the second transistor are configured such that the variations in first-transistor threshold voltage and the second-transistor threshold voltage substantially cancel each other out.

9. A method of reducing voltage variations in a power supply, the method comprising:

generating, by a voltage regulator, an intermediate voltage at an intermediate node of a power supply based on a reference voltage at a reference node of the power supply;

setting a first-transistor gate voltage at a first-transistor gate of a first transistor of the power supply based on the intermediate voltage;

setting an output voltage at an output node of the power supply based on a second-transistor gate voltage at a second-transistor gate of a second transistor; and setting the second-transistor gate voltage based on the first-transistor gate voltage such that the output voltage is based on the intermediate voltage, a first-transistor threshold voltage of the first transistor, and a second-transistor threshold voltage of the second transistor and such that variations in the first-transistor threshold voltage and the second-transistor threshold voltage at least partially cancel each other out;

filtering out noise between the first-transistor gate and the second-transistor gate;

supplying a charge voltage to the second-transistor gate to reduce a settling time of a filter performing the filtering;

comparing a first-gate voltage of the first-transistor gate with a second-gate voltage of the second-transistor gate; and turning off a charge device supplying the charge voltage when the comparison indicates that the second-gate voltage is substantially equal to the first-gate voltage.

10. The method of claim 9, wherein the voltage regulator includes the first transistor.

11. The method of claim 9, further comprising maintaining the charge device in an off state when the comparison indicates that the first gate voltage and the second gate voltage are no longer substantially equal to each other.

12. The method of claim 9, wherein the first transistor and the second transistor are configured such that the output voltage is substantially equal to the intermediate voltage.

13. The method of claim 9, further comprising:

drawing a load current through the second transistor and the output node; and supplying, by a current source, a reference current through the first transistor, wherein the current source, the first transistor, and the second transistor are configured such that a current ratio of the reference current with respect to the load current is substantially equal to a width ratio of a first-transistor width of the first transistor with respect to a second-transistor width of the second transistor.

14. The method of claim 9, wherein the first transistor and the second transistor are configured such that the first-transistor threshold voltage and the second-transistor threshold voltage substantially cancel each other out.

* * * * *